US006021728A

United States Patent [19]

Delrieu

[11] Patent Number: 6,021,728

[45] **Date of Patent: *Feb. 8, 2000**

[54] BUOYANCY UNIT WITH CONTROLLED HEAVE

[75] Inventor: Jean-Luc Delrieu, Pau, France

[73] Assignee: Elf Exploration Production, France

[ * ] Notice: This patent issued on a continued prosecution application filed under 37 CFR 1.53(d), and is subject to the twenty year patent term provisions of 35 U.S.C. 154(a)(2).

[21] Appl. No.: 08/935,738

[22] Filed: Sep. 23, 1997

[30] Foreign Application Priority Data

Sep. 24, 1996 [FR] France ..... 96 11618

[51] Int. Cl.[7] ..... B63B 39/03

[52] U.S. Cl. ..... 114/125; 114/265

[58] Field of Search ..... 114/121, 123, 114/125, 264, 265, 266

[56] References Cited

U.S. PATENT DOCUMENTS

| | | | |
|---|---|---|---|
| 3,537,412 | 11/1970 | Henderson | 114/125 |
| 3,797,440 | 3/1974 | Pangalila | 114/125 |
| 3,886,886 | 6/1975 | Anders | 114/125 |
| 3,915,108 | 10/1975 | Rodriguez | 114/125 |
| 4,100,873 | 7/1978 | Kaldenbach | 114/125 |
| 4,216,559 | 8/1980 | Switlik | 114/125 |
| 4,232,623 | 11/1980 | Chou et al. | 114/125 |
| 4,452,165 | 6/1984 | Bergman | 114/125 |

FOREIGN PATENT DOCUMENTS

| | | | |
|---|---|---|---|
| 2681831 | 4/1993 | France | 114/125 |
| 832 853 | 4/1960 | United Kingdom . | |

OTHER PUBLICATIONS

Patent Abstracts of Japan, vol. 12, No. 409 (M–758), Oct. 28, 1988 & JP 63 149285 A (Mitsubishi Heavy Industries), Jun. 22, 1988.

*Primary Examiner*—Stephen Avila
*Attorney, Agent, or Firm*—Bacon & Thomas, PLLC

[57] ABSTRACT

Buoyancy unit comprising a body (14) in which there are formed a buoyancy chamber (20) and a chamber (22) which is intended to become filled with water. According to the invention, the wall of the chamber (22) has at least two openings (24, 28), at least one opening of which comprises a nozzle (24, 28) allowing the passage of water between the chamber (22) and the outside, the nozzle being dimensioned in such a way as to appreciably slow the flow of water. The unit may form a buoyancy column intended to hold the deck of a floating rig up out of the water.

9 Claims, 2 Drawing Sheets

BUOYANCY UNIT WITH CONTROLLED HEAVE

BACKGROUND OF THE INVENTION

The present invention relates to a buoyancy unit with controlled heave, and more particularly to a unit of this kind intended to hold the deck of a floating oil rig up out of the water.

Floating oil rigs are subjected to wave motion which, during the passage of a wave, alters the draught of the rig. This variation causes the rig to move along the vertical axis, as the rig attempts to maintain constant draught.

Each sea has its own geographical conditions which give the wave motion associated characteristics: mean height of the waves and frequency of the wave motion. The shape and dimensions of a rig give a specific response time during the passage of a wave. In order to avoid problems of resonance it is necessary for the natural periods of the wave motion and of the rig to be sufficiently different.

DESCRIPTION OF RELATED ART

Document FR-A-2,681,831 describes a floating oil rig with controllable heave comprising a deck and a buoyancy unit. In order to control the response of the rig to the movement of the sea in which it is installed, the buoyancy unit comprises a tidal chamber open to the sea and connected to a gas tank by a circulation conduit fitted with a restriction.

In spite of its advantages, the buoyancy unit described in document FR-A-2,681,831 has the drawback of having a complicated construction, which increases the cost of manufacturing it.

SUMMARY OF THE INVENTION

The subject of the present invention is therefore a buoyancy unit with controlled heave which is of a simple and reliable construction and makes it possible to limit the vertical movements of a floating rig.

In order to achieve this objective, the present invention proposes a buoyancy unit comprising a body in which there are formed a buoyancy chamber and a chamber which is intended to become filled with water, characterized in that the wall of the chamber has at least two openings, at least one opening of which comprises a nozzle allowing the passage of water between the chamber and the outside, the nozzle being calibrated in such a way as to appreciably slow the flow of water.

This type of rig is particularly suitable for seas where the wave motion has a long period, for example the Gulf of Guinea.

A rig fitted with the buoyancy unit according to the invention has advantages of manufacturing cost and enables the rig to be assembled directly on site, the buoyancy columns being manufactured in the region of installation and only the deck being constructed in a remote shipyard. In addition, such a rig can be installed without having to use heavy equipment. The deck is an independent barge which arrives on site fully equipped.

The advantages, as well as the operation of the present invention will emerge more clearly on reading the following description given in non-limiting manner with reference to the attached drawings.

BRIEF DESCRIPTION OF THE FIGURES OF DRAWINGS

FIG. 1 is a diagrammatical view of an oil rig at sea equipped with a buoyancy unit according to the invention; and FIG. 2 is a longitudinal section of one of the columns used in the rig of FIG. 1 and comprising the buoyancy unit according to the invention

DETAILED DESCRIPTION OF THE PREFERRED EMBODIMENT

Figure 1:
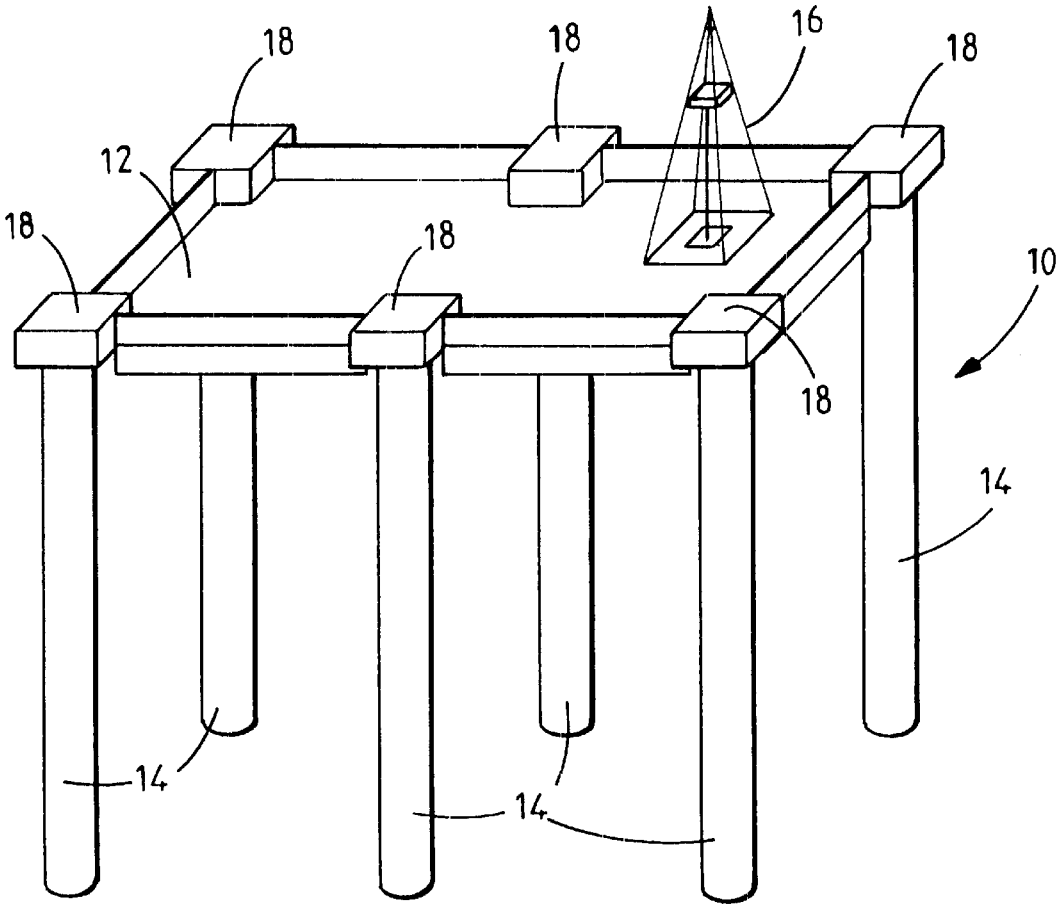

In FIG. 1, an oil rig with controlled heave is depicted overall as 10. The rig 10 comprises a floating deck 12 which is mounted on the upper ends of buoyancy columns 14. The deck 10 comprises at least three columns 14, and six in the example illustrated. The six buoyancy columns are more or less identical and will be described in greater detail hereinafter. The columns may have a rectangular cross-section, or preferably a circular cross-section. A drilling mast, depicted diagrammatically in 16, is mounted on the deck 12.

The deck 12 is fitted with six bearing cages 18 arranged around its periphery, each one intended to receive the upper end of an associated buoyancy column 14. The upper end of each column 14 preferably bears on the lower surface of the associated cage 18 via a set of blocks made of elastomer and arranged in a circle on the lower surface, which makes it possible to spread the load on the end of the column 14 and form a joint. Other types of joint, for example a spherical bearing surface, can also be used.

Each column 14, having the form of a tube which defines a body with closed ends, is preferably made of steel, concrete, or possibly fibreglass. Each column is arranged vertically in the water, its upper end having an air draught "h" relative to the water surface 15. A buoyancy chamber 20 defined at the upper end of the column 14 (looking at the drawing) is dimensioned so that its centre of buoyancy is above the centre of mass of the column 14, in order to give it greater stability. Each column is preferably weighed down at its lower end.

Defined in the lower part of the column 14 is a chamber 22 that forms a water trap. This chamber opens to the outside of the column via at least two openings, an upper opening 24 arranged adjacent to a partition 26 delimiting the bottom of the buoyancy chamber 20 and via a lower opening 28 arranged towards the lower end 29 of the column 14. At its lower end, the column has a chamber 30 intended to contain ballast.

At least one of the orifices 24 and 28 is dimensioned to form a nozzle, intended to slow the flow of water between the chamber 22 and the outside, as will be described in greater detail hereinafter.

Now, as the rig 10 moves vertically, each column 14 is displaced more or less vertically, in the direction of the arrow 30. This vertical movement tends to displace the mass of water held in the chamber 22 towards the top or towards the bottom of the column, in the opposite direction to the movement of the column. This vertical movement actually creates a pressure gradient in the water inside the chamber 22. This pressure gradient consists of a slight depression at one end of the chamber 22 and a slight overpressure at the opposite end, compared to the pressure of the water surrounding the column.

The difference between the pressures at the ends of the chamber 22 and the pressure of the water outside causes the water in the chamber to accelerate and this tends to drive it out of the chamber at one of its ends to be replaced with water entering the chamber from the opposite end. The friction caused in the nozzle 24, 28 as the water entering or leaving the chamber 22 passes, converts some of its kinetic energy into heat. This conversion reduces the heave energy of the column/water unit, the result of this being an attenuation of its vertical movement. The heat generated by the friction of the water through the nozzles is dissipated into the sea water.

The restriction of the nozzle 24, 28 may be variable, for example controlled from the deck 12 of the rig 10. Alternatively, the nozzle control may be connected to a measurement unit fitted with accelerometers, which is intended to measure the rate of vertical displacement of each column 14 in order to optimize the attenuation of the vertical movement, and which controls the nozzles of each column separately so that the columns are displaced as one, thus making the deck stable.

As the lower part of the column is open to the water, this makes it possible for its structure to be lighter. Only the upper part that forms the chamber 20, which is intended to support the weight of the deck needs to have reinforced construction.

The openings 24, 28 may each comprise a calibrated nozzle so as to slow still further the flow of the water. Alternatively, one of the openings 28 may be formed by the open bottom 29 of the column, which enables the construction of the column to be simplified. This type of construction requires the column 14 to be longer.

To supplement the foregoing description, a numerical example is given hereinafter, without implied limitation.

Figure 2:
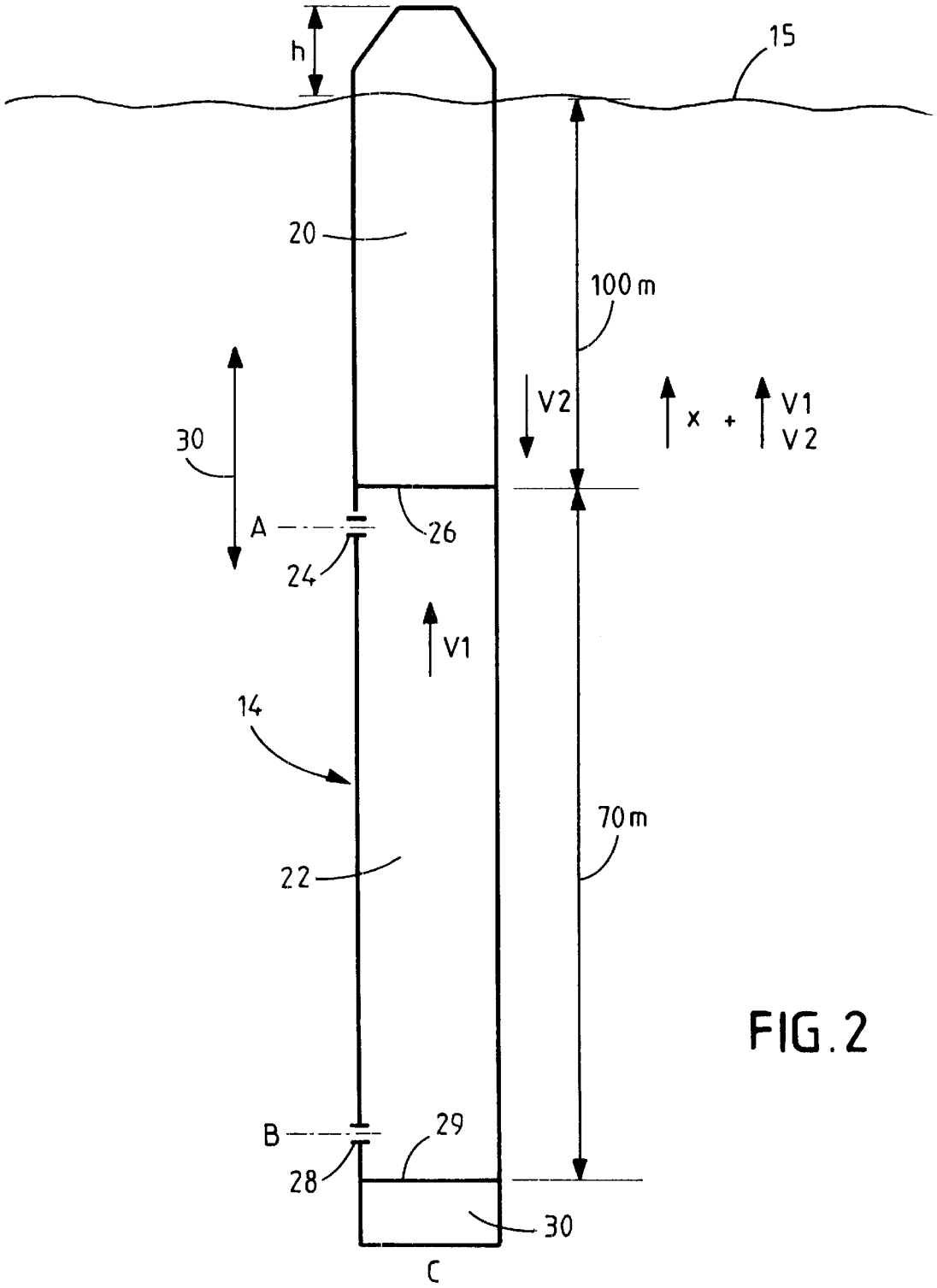

The dimensions of the column 14 are marked on FIG. 2. The mass of the column, empty, is $M_2$ and the chamber 22 contains a mass $M_1$ of water. The column 14 experiences a regular wave motion, which tends to displace the column under the effect of the pressure at C and tends to displace the mass of water $M_1$ under the effect of the pressures at A and B. The x-axes of the column and the speeds $V_1$ and $V_2$ are taken as being positive upwards.

The following assumptions are made:

x=1.182 m: the column has risen by more than one meter from its equilibrium position.

$V_1$=+0.101 m/s $V_2$=−0.126 m/s.

For simplicity, it will be assumed that the cross-sectional area of the column is 1 $m^2$.

Water flow rate: 0.101−(−0.126)=0.227 tonne/second.

The cross-sectional area of the orifices is $$\frac{1\,\mathrm{m}^2}{15.3} \quad (n = 15.3)$$

15.3 is an estimated value which was chosen bearing in mind the rates of displacement of the column and of the water, the rate of displacement of the water being of the order of half the rate of displacement of the column.

This value was estimated in order to optimize damping. The speed at which water is ejected from the nozzle 24 is 0.227 m/s×15.3−3.47 m/s.

| | |
|---|---|
| The external pressures are: | |
| $P_A$ = | 10.38 kPa |
| $P_B$ = | −4.36 kPa |
| $P_C$ = | −3.85 kPa |
| Inside the column, there are: | |
| $P_{A'}$ = | −4.35 kPa |
| $P_{B'}$ = | −10.39 kPa |

Now it is known tha Δp across an orifice is $$\frac{1}{2}\rho V^2$$

$$\rho = 1\ \mathrm{t/m^3} \text{ with } F \text{ in kN}$$

$$\Delta p = \frac{1}{2}V^2 = \frac{1}{2}3.47^2 = 6.02\ \mathrm{kPa}\ (\mathrm{kN/m^2})$$

$$p_{A'} = p_A + \Delta p = -10.38 + 6.03 = -4.35\ \mathrm{kPa}$$

$$p_{B'} = -4.36 - 6.03 = -10.39\ \mathrm{kPa}$$

It is convenient to write down the pressure forces acting on the column (which is 1 $m^2$ in cross-section) in two different ways:

| | | | | |
|---|---|---|---|---|
| Pressure at: | A | −4.43 kN | Wave forces: | −10.38 kN at A |
| | B | +10.39 kN | | +0.52 kN at B & C |
| | C | −3.85 kN | Damping | +12.06 kN at A & C) |
| Upthrust | | −11.59 kN | Upthrust | −11.59 kN |
| Resultant on the column | | −9.40 kN | | −21.45 kN |

It can thus be seen that the damping forces are far from insignificant in terms of amplitude, because the damping device reduces the external force from −21.45 kN in situations when the orifices 24, 28 are closed and therefore when the rates of displacement of the column and of the water $V_1$, $V_2$, are equal to −9.40 kN.

Thus the buoyancy unit according to the invention allows the heave of the rig to be reduced considerably.

The energy dissipated per second is, on average, 0.92 kW. The system tends towards steady state and the dissipated power becomes 1.11 kW. In this example, if upthrust is neglected, the work done by the forces generated by the wave swell pressures is 1.24 kW at the moment in question (−9.87 kN×0.126 m/s).

The excitation period chosen is T=18 s. The maximum pressures for a wave swell 7 m crest-to-trough is 390=11.2 kPa, 3160=4.7 kPa, 3170=4.15 kPa.

The buoyancy unit according to the invention may form a subassembly intended to be attached to a floating structure in order to dampen the overall heave. Furthermore, the buoyancy unit may be arranged other than vertically. For example, the unit may be installed, generally horizontally, under the hull of a ship in order to dampen the roll, yaw or pitching. Alternatively, the unit may be arranged inside a ship or inside a floating structure with the openings open to the water.

What is claimed is:

1. Buoyancy unit comprising a column in which there are formed a buoyancy chamber and a single chamber which is intended to become filled with water, wherein the wall of the chamber has at least two openings vertically spaced at different depths both of which are continuously open to the water, at least one opening of which comprises an opening of restricted diameter allowing the passage of water between the chamber and the outside, the opening of restricted diameter being dimensioned in such a way as to appreciably slow the flow of water therethrough.

2. Buoyancy unit according to claim 1, wherein the opening of restricted diameter is arranged near one end of the chamber.

3. Buoyancy unit according to claim 1, wherein the unit comprises at least one buoyancy column and one of the two openings is formed by an open bottom of the buoyancy column.

4. Buoyancy unit according to claim 1, wherein two of said openings are openings of restricted diameter dimensioned in such a way as to appreciably slow the flow of water therethrough.

5. An off-shore oil rig with controlled heave comprising a floating deck which is mounted on upper ends of at least three buoyancy columns, each buoyancy column comprising an upper part including a buoyancy chamber therein and a lower part including a single chamber having a wall with at least two openings vertically spaced at different depths both of which are open to the sea water, at least one opening of which comprises an opening of restricted diameter allowing the passage of sea water between the chamber and the outside, the opening of restricted diameter being dimensioned in such a way as to appreciably slow the flow of sea water therethrough.

6. The off-shore oil rig according to claim 5, wherein the opening of restricted diameter is variable.

7. The off-shore oil rig according to claim 6, wherein the variable opening of restricted diameter is controlled from the deck of the rig.

8. The off-shore oil rig according to claim 7, wherein each variable opening of restricted diameter in each column is controlled separately.

9. The off-shore oil rig according to claim 8, wherein the control of the variable opening of restricted diameters is associated with measuring means having accelerometers which measure the rate of vertical displacement of each column.

* * * * *